US008717255B2

(12) United States Patent
Phan

(10) Patent No.: US 8,717,255 B2
(45) Date of Patent: May 6, 2014

(54) IMAGE DEVICE WITH PIXEL DOTS WITH MULTI-PRIMARY COLORS

(75) Inventor: Gia Chuong Phan, Hong Kong (CN)

(73) Assignee: VP Assets Limited, Shatin, N.T., Hong Kong (CN)

( * ) Notice: Subject to any disclaimer, the term of this patent is extended or adjusted under 35 U.S.C. 154(b) by 429 days.

(21) Appl. No.: 12/906,619

(22) Filed: Oct. 18, 2010

(65) Prior Publication Data

US 2012/0092237 A1 Apr. 19, 2012

(51) Int. Cl.
*G09G 3/20* (2006.01)

(52) U.S. Cl.
USPC ..... 345/55

(58) Field of Classification Search
USPC ..... 345/76–115, 201–211, 55
See application file for complete search history.

(56) References Cited

U.S. PATENT DOCUMENTS 4,800,375 A * 1/1989 Silverstein et al. ..... 345/694
2004/0174389 A1* 9/2004 Ben-David et al. ..... 345/694
2005/0151752 A1* 7/2005 Phan ..... 345/589
2010/0141812 A1* 6/2010 Hirota ..... 348/279

FOREIGN PATENT DOCUMENTS

| | | | |
|---|---|---|---|
| CN | 1494036 | A | 5/2004 |
| CN | 1509083 | A | 6/2004 |
| CN | 1722193 | A | 1/2006 |
| CN | 101286311 | A | 10/2008 |
| CN | 102243828 | A | 11/2011 |

* cited by examiner

*Primary Examiner* — Liliana Cerullo
(74) *Attorney, Agent, or Firm* — Birch, Stewart, Kolasch & Birch, LLP

(57) ABSTRACT

An image device includes a plurality of pixel groups. Each pixel group includes a plurality of dots arranged in a predetermined identical matrix form, and each pixel group has at least one first color dot, at least one second color dot, at least one third color dot and at least one fourth color dot. Any repeated sequence of consecutive color dots in a row direction and in a column direction comprise at least one first color dot, at least one second color dot, at least one third color dot, at least one fourth color dot. The advantage of the invention is to provide all multi-primary colors in a single row or column so that by using subpixel rendering method, black and white lines can be formed in rows or columns, thus reducing the number of columns in a multi-primary colors display.

26 Claims, 6 Drawing Sheets

IMAGE DEVICE WITH PIXEL DOTS WITH MULTI-PRIMARY COLORS

BACKGROUND OF THE INVENTION

1. Field of the Invention

The invention relates to an image device, and particularly to an image device with repeated sequence of consecutive color dots in a row direction and in a column direction.

2. Description of the Related Art

Referring to FIG. 1, it shows a conventional RGB stripe display. The conventional RGB stripe display 10 comprises a plurality of RGB pixel groups 11 and 12. The RGB pixel group 11 includes a red dot (R1) 111, a green dot (G1) 112 and a blue dot (B1) 113 arranged in a row direction, and the RGB pixel group 12 includes a red dot (R2) 121, a green dot (G2) 122 and a blue dot (B2) 123 arranged next to the RGB pixel group 11 in the row direction. In a column direction, the same color dots, for example red dot 111, are arranged in the same column, therefore one column alone does not have all the colors needed for creating a white color column.

U.S. Pat. No. 7,583,279 teaches different non conventional multicolor displays wherein black and white line can be formed in rows or columns. The deficiency is that such display uses stripe subpixels which need at least 2 columns to contain all the multi color for forming a white column since one column alone does not have all the colors needed for creating a white color.

Therefore, there is a need for an image display to solve the above problems.

SUMMARY OF THE INVENTION

The present invention is to provide an image device. The image device includes a plurality of pixel groups. Each pixel group includes a plurality of dots arranged in a predetermined identical matrix form, and each pixel group has at least one first color dot, at least one second color dot, at least one third color dot and at least one fourth color dot. Any repeated sequence of consecutive color dots in a row direction and in a column direction comprise at least one first color dot, at least one second color dot, at least one third color dot, at least one fourth color dot.

The advantage of the invention is to provide all multi-primary colors in a single row or column so that by using subpixel rendering method, black and white lines can be formed in rows or columns, thus reducing the number of columns in a multi-primary colors display.

BRIEF DESCRIPTION OF THE DRAWING

Further advantageous measures are described in the dependent claims. The invention is shown in the attached drawing and is described hereinafter in greater detail.

DETAILED DESCRIPTION OF THE INVENTION

Figure 2:
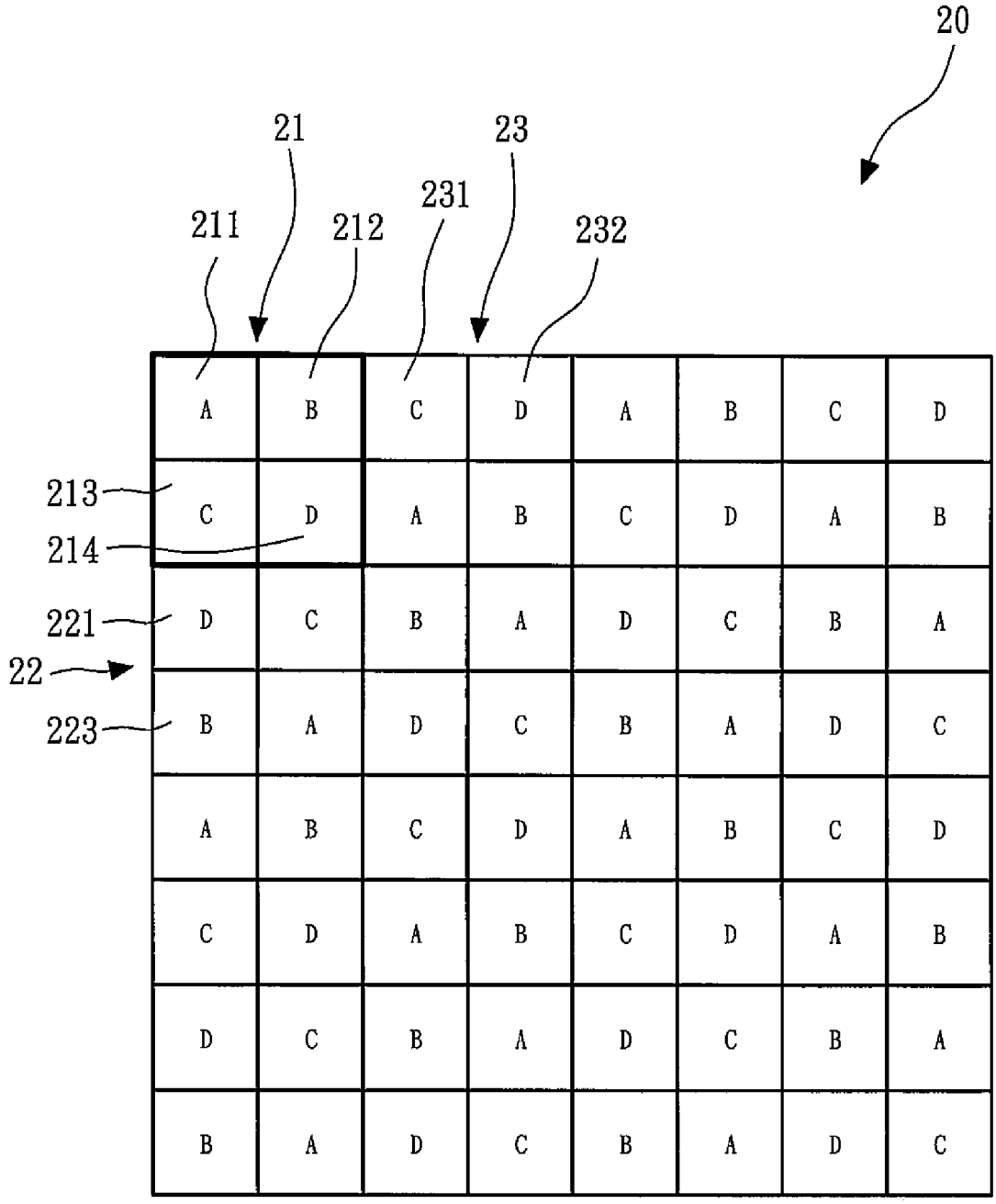
FIG. 2 shows the image device according to a first embodiment of the invention.

Referring to FIG. 2, it shows the image device according to a first embodiment of the invention. The image device 20 includes a plurality of pixel groups 21, 22, 23. Each pixel group includes a plurality of dots arranged in a predetermined identical matrix form, and each pixel group has at least one first color dot, at least one second color dot, at least one third color dot and at least one fourth color dot. For example, the first pixel group 21 has at least one first color dot 211 (A), at least one second color dot 212 (B), at least one third color dot 213 (C) and at least one fourth color dot 214 (D). The first color dot 211 (A), the second color dot 212 (B), the third color dot 213 (C) and the fourth color dot 214 (D) do not be limited to any color.

In this embodiment, the pixel group comprises four color dots arranged in a 2×2 matrix. An initial 2×2 pixel group, for example the first pixel group 21, in the upper left corner of the image device 21 comprises at least one first color dot 211 (A), at least one second color dot 212 (B), at least one third color dot 213 (C) and at least one fourth color dot 214 (D).

Any repeated sequence of consecutive color dots in a row direction and in a column direction comprise at least one first color dot, at least one second color dot, at least one third color dot, at least one fourth color dot. In this embodiment, the repeated sequence of consecutive color dots in the row direction comprises for example the first color dot 211 (A) of the first pixel group 21, the second color dot 212 (B) of the first pixel group 21, the third color dot 231 (C) of the third pixel group 23, the fourth color dot 232 (D) of the third pixel group 23, and the same repeated sequence of consecutive color dots are arranged sequentially and repeatedly in the row direction.

The repeated sequence of consecutive color dots in the column direction comprises for example the first color dot 211 (A) of the first pixel group 21, the third color dot 213 (C) of the first pixel group 21, the fourth color dot 221 (D) of the second pixel group 22, the second color dot 223 (B) of the second pixel group 22, and the same repeated sequence of consecutive color dots are arranged sequentially and repeatedly in the column direction.

Figure 3:
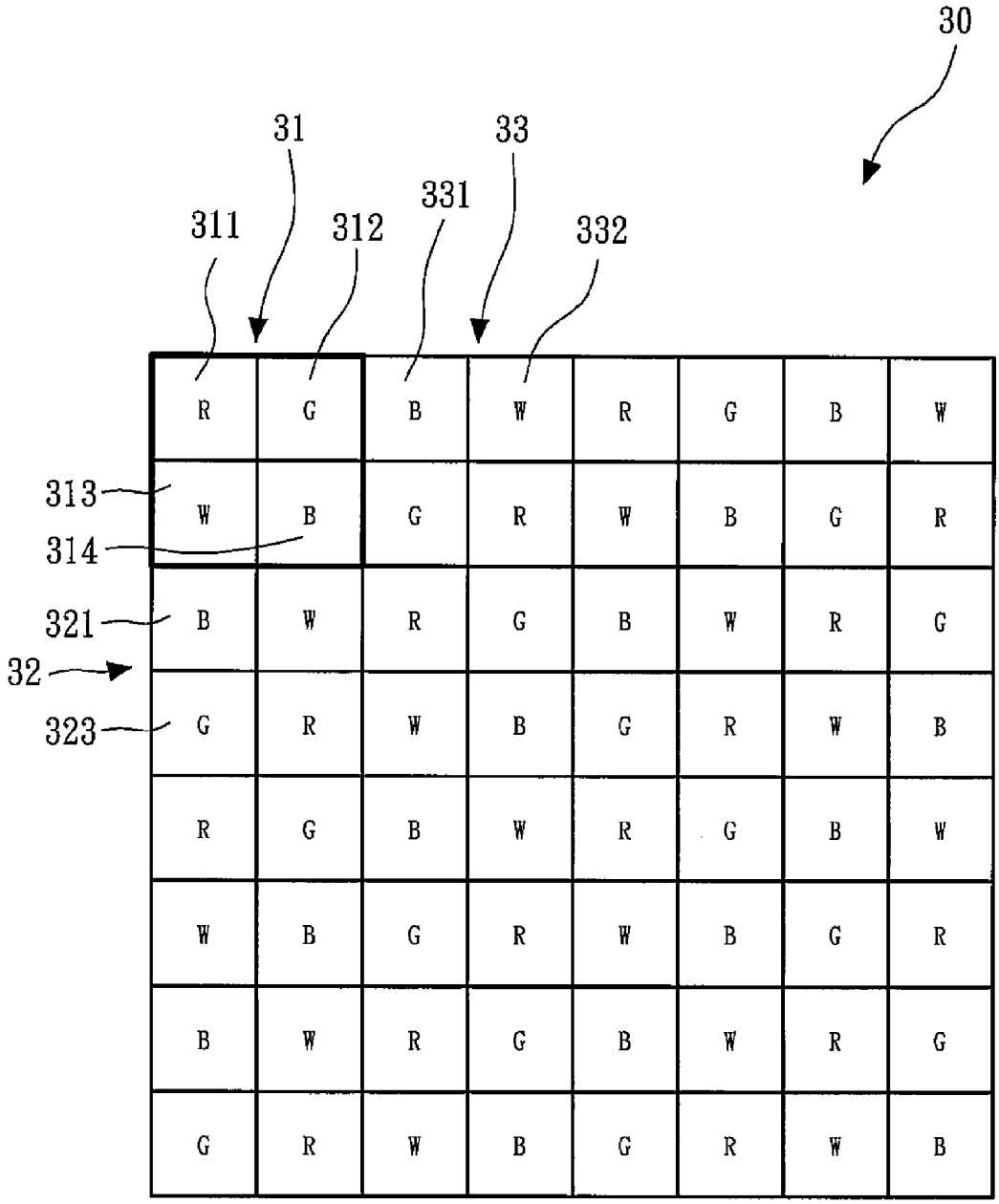
FIG. 3 shows the image device according to a second embodiment of the invention.

Referring to FIG. 3, it shows the image device according to a second embodiment of the invention. The image device 30 includes a plurality of pixel groups 31, 32, 33. Each pixel group includes a plurality of dots arranged in a predetermined identical matrix form, and each pixel group has at least one first color dot, at least one second color dot, at least one third color dot and at least one fourth color dot. For example, the first pixel group 31 has at least one red color dot 311 (R), at least one green color dot 312 (G), at least one white color dot 313 (W) and at least one blue color dot 314 (B). In this embodiment, each pixel group comprises at least one white color dot, and each pixel group comprises at least one red color dot, one green color dot and one blue color dot. Preferably, red color dot (R) and blue color dot (B) are disposed on diagonal positions of the predetermined identical matrix of the pixel group. Furthermore, same color dots do not share common edge line.

Any repeated sequence of consecutive color dots in a row direction and in a column direction comprise at least one first color dot, at least one second color dot, at least one third color dot, at least one fourth color dot. In this embodiment, the repeated sequence of consecutive color dots in the row direction comprises for example the red color dot 311 (R) of the first pixel group 31, the green color dot 312 (G) of the first pixel group 31, the blue color dot 331 (B) of the third pixel group 33, the white color dot 332 (W) of the third pixel group 33, and the same repeated sequence of consecutive color dots are arranged sequentially and repeatedly in the row direction.

Figure 1:
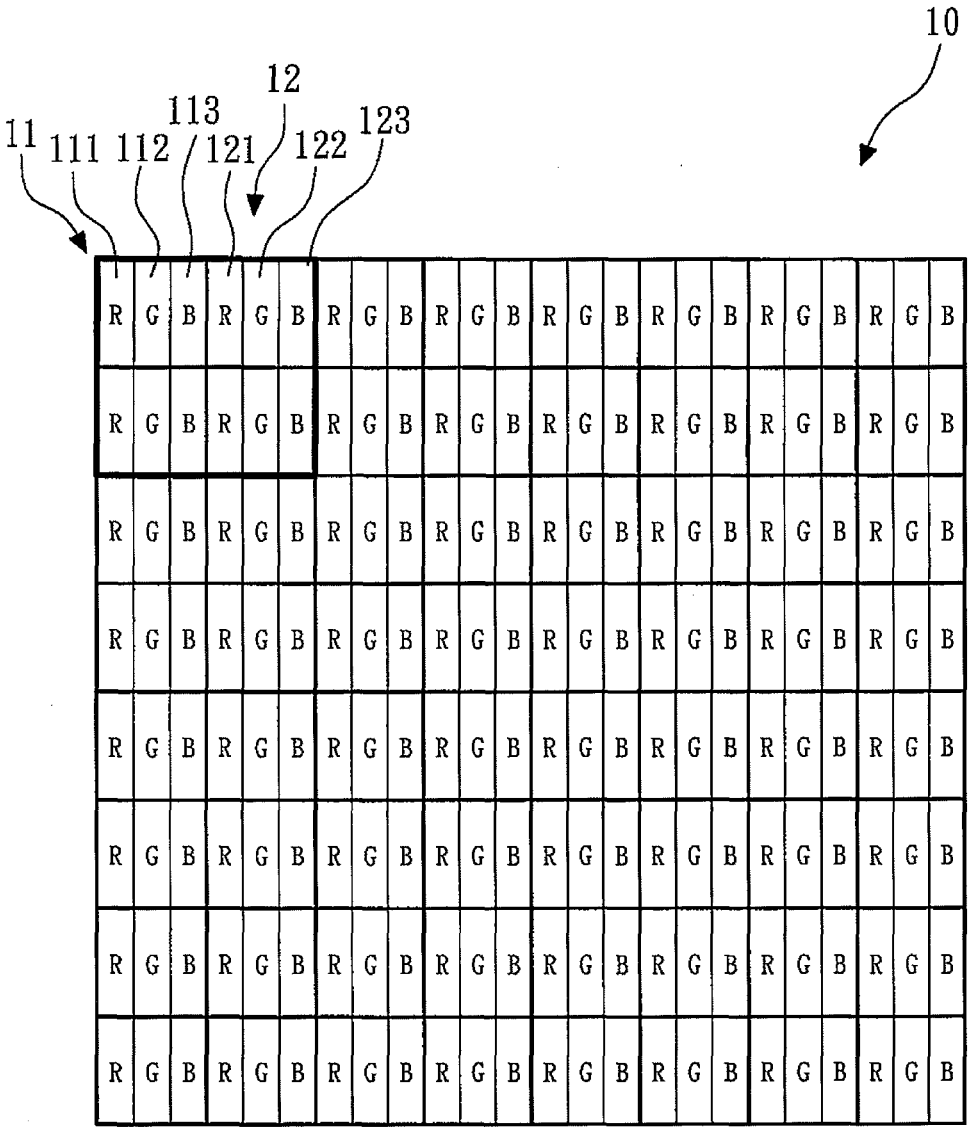
FIG. 1 PRIOR ART
FIG. 1 shows a conventional RGB stripe display.

The repeated sequence of consecutive color dots in the column direction comprises for example the red color dot 311 (R) of the first pixel group 31, the white color dot 313 (W) of the first pixel group 31, the blue color dot 321 (B) of the second pixel group 32, the green color dot 323 (G) of the second pixel group 32, and the same repeated sequence of consecutive color dots are arranged sequentially and repeatedly in the column direction. Furthermore, in this embodiment, the area of 2×2 color dots is equal to the corresponding area of 2×2 RGB pixel groups of a conventional RGB stripe display (as shown in FIG. 1).

Figure 4:
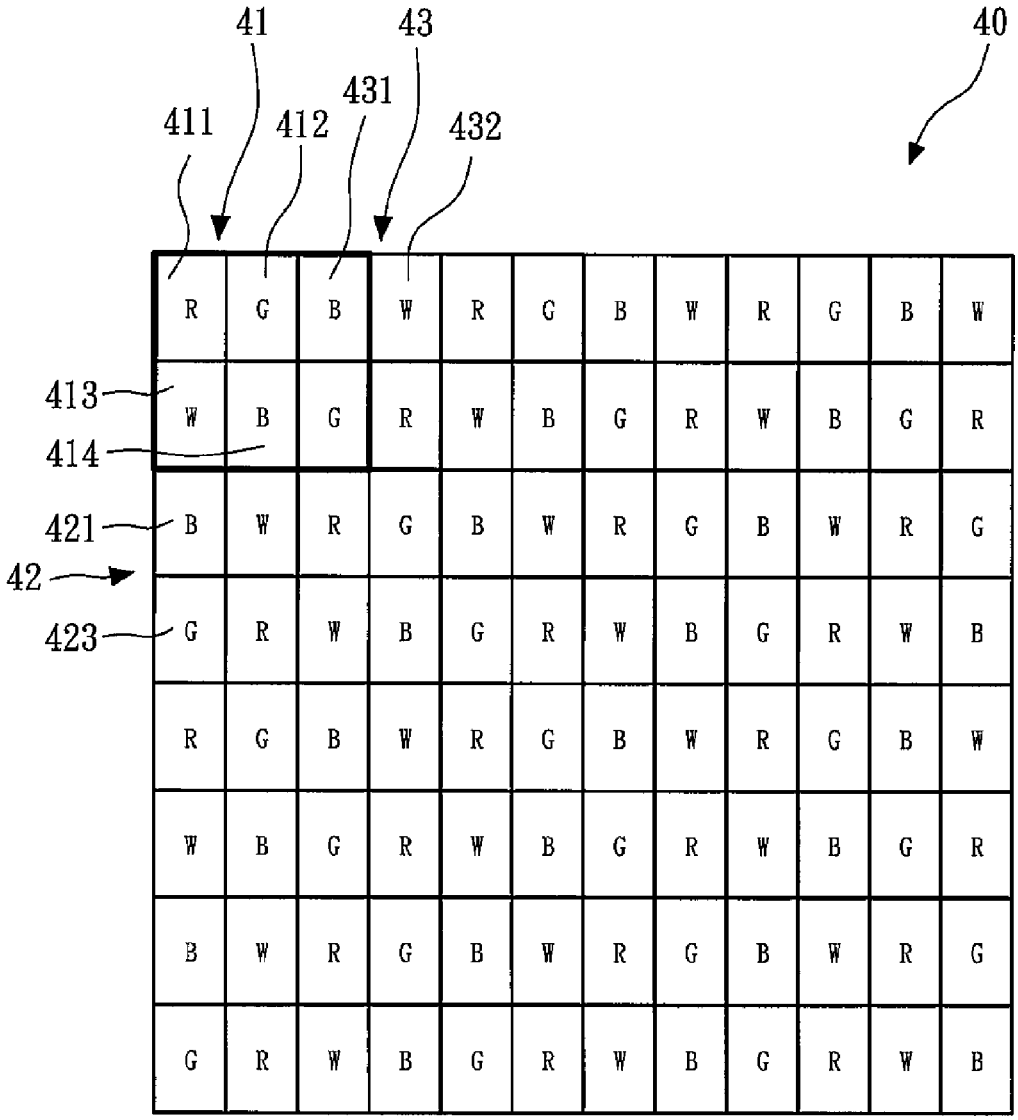
FIG. 4 shows the image device according to a third embodiment of the invention.

Referring to FIG. 4, it shows the image device according to a third embodiment of the invention. The image device 40 includes a plurality of pixel groups 41, 42, 43. The pixel group comprises four color dots arranged in a 2×2 matrix. In this embodiment, the repeated sequence of consecutive color dots in the row direction comprises for example the red color dot 411 (R) of the first pixel group 41, the green color dot 412 (G) of the first pixel group 41, the blue color dot 431 (B) of the third pixel group 43, the white color dot 432 (W) of the third pixel group 43, and the same repeated sequence of consecutive color dots are arranged sequentially and repeatedly in the row direction.

The repeated sequence of consecutive color dots in the column direction comprises for example the red color dot 411 (R) of the first pixel group 41, the white color dot 413 (W) of the first pixel group 41, the blue color dot 421 (B) of the second pixel group 42, the green color dot 423 (G) of the second pixel group 42, and the same repeated sequence of consecutive color dots are arranged sequentially and repeatedly in the column direction. The difference between the second embodiment and the third embodiment is that, in this embodiment, the area of 3×2 color dots is equal to the corresponding area of 2×2 RGB pixel groups of a conventional RGB stripe display (as shown in FIG. 1).

Figure 5:
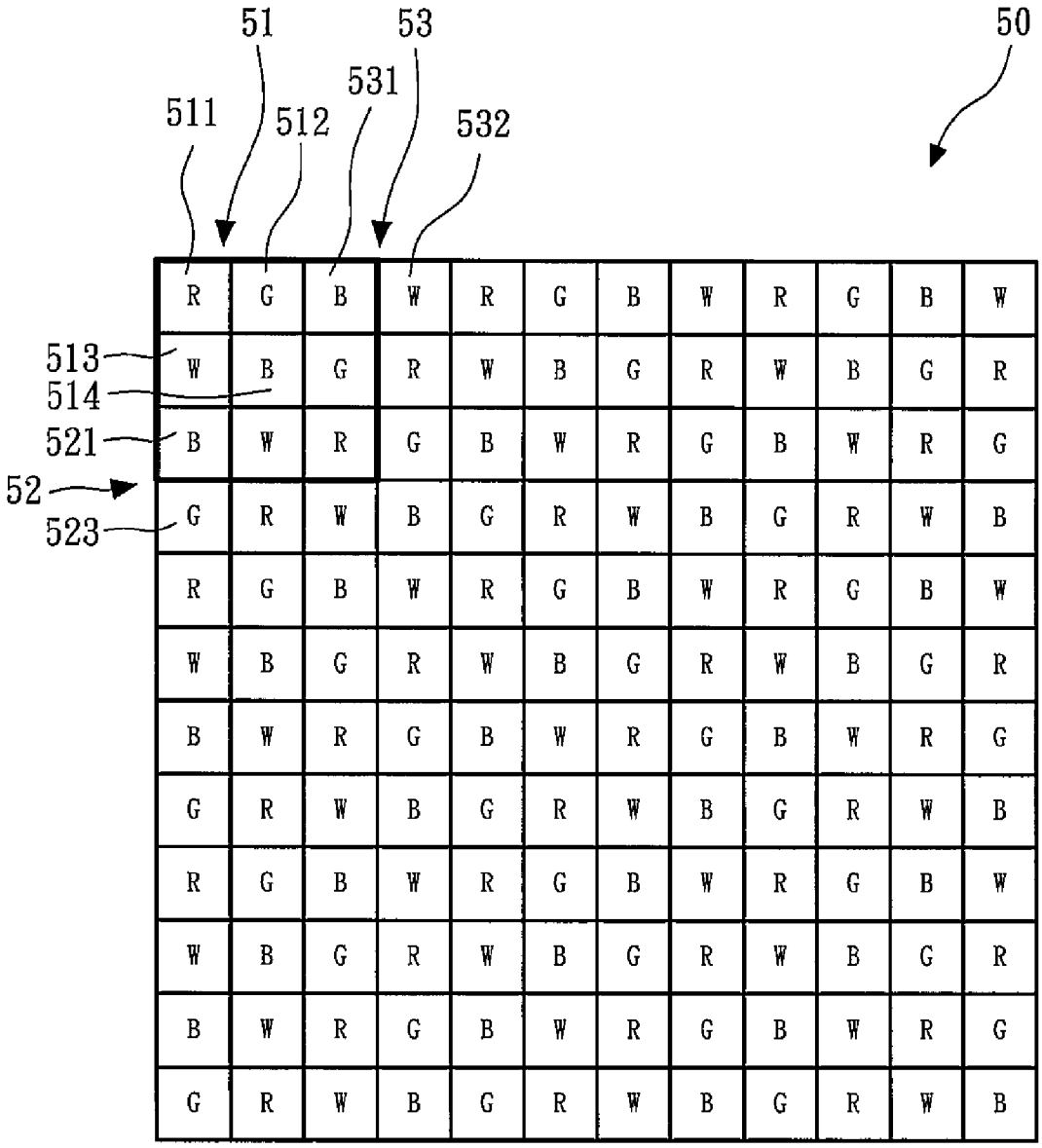
FIG. 5 shows the image device according to a fourth embodiment of the invention.

Referring to FIG. 5, it shows the image device according to a fourth embodiment of the invention. The image device 50 includes a plurality of pixel groups 51, 52, 53. The pixel group comprises four color dots arranged in a 2×2 matrix. In this embodiment, the repeated sequence of consecutive color dots in the row direction comprises for example the red color dot 511 (R) of the first pixel group 51, the green color dot 512 (G) of the first pixel group 51, the blue color dot 531 (B) of the third pixel group 53, the white color dot 532 (W) of the third pixel group 53, and the same repeated sequence of consecutive color dots are arranged sequentially and repeatedly in the row direction.

The repeated sequence of consecutive color dots in the column direction comprises for example the red color dot 511 (R) of the first pixel group 51, the white color dot 513 (W) of the first pixel group 51, the blue color dot 521 (B) of the second pixel group 52, the green color dot 523 (G) of the second pixel group 52, and the same repeated sequence of consecutive color dots are arranged sequentially and repeatedly in the column direction. The difference between the second embodiment and the fourth embodiment is that, in this embodiment, the area of 3×3 color dots is equal to the corresponding area of 2×2 RGB pixel groups of a conventional RGB stripe display (as shown in FIG. 1).

Figure 6:
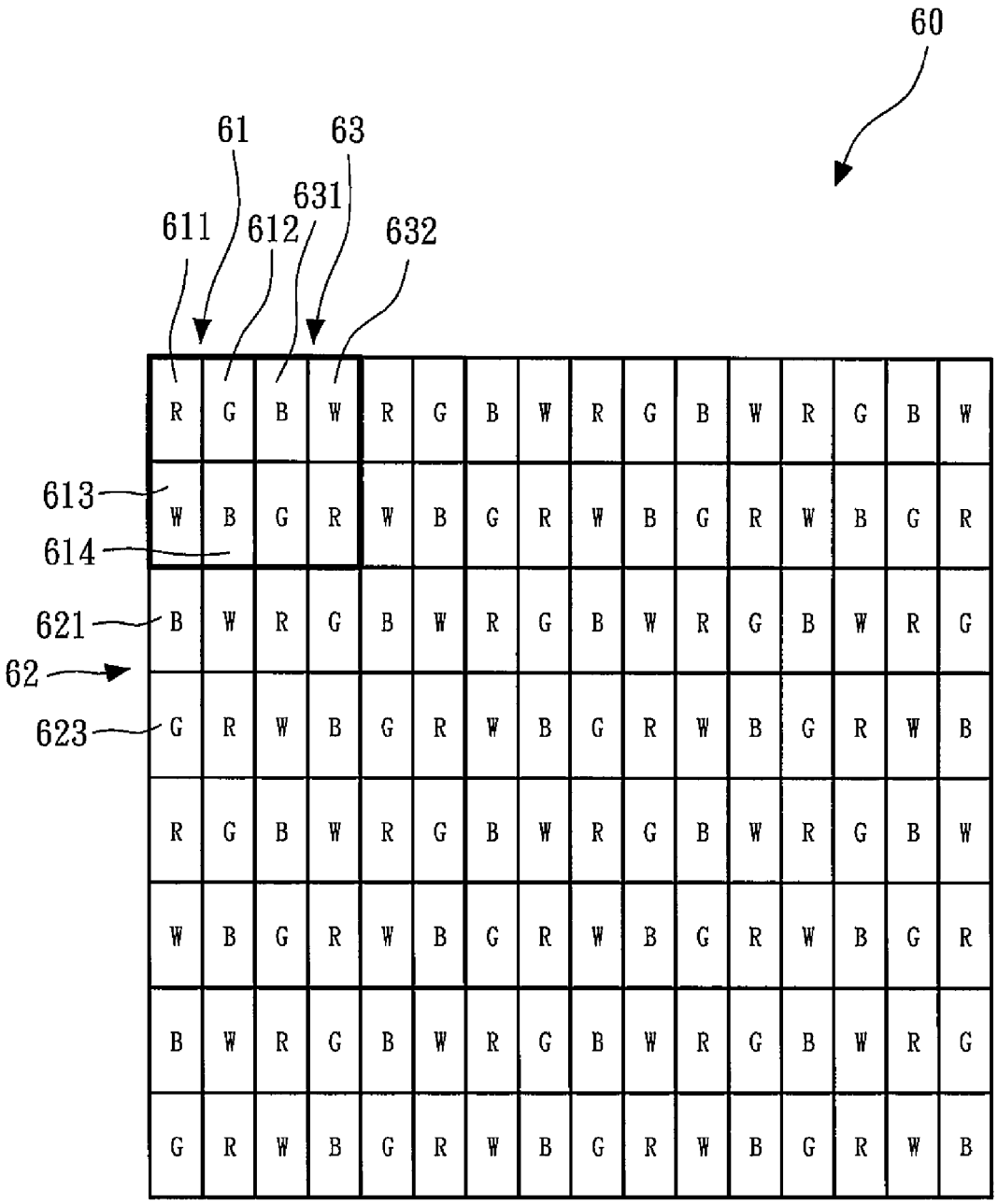
FIG. 6 shows the image device according to a fifth embodiment of the invention.

Referring to FIG. 6, it shows the image device according to a fifth embodiment of the invention. The image device 60 includes a plurality of pixel groups 61, 62, 63. The pixel group comprises four color dots arranged in a 2×2 matrix. In this embodiment, the repeated sequence of consecutive color dots in the row direction comprises for example the red color dot 611 (R) of the first pixel group 61, the green color dot 612 (G) of the first pixel group 61, the blue color dot 631 (B) of the third pixel group 63, the white color dot 632 (W) of the third pixel group 63, and the same repeated sequence of consecutive color dots are arranged sequentially and repeatedly in the row direction.

The repeated sequence of consecutive color dots in the column direction comprises for example the red color dot 611 (R) of the first pixel group 61, the white color dot 613 (W) of the first pixel group 61, the blue color dot 621 (B) of the second pixel group 62, the green color dot 623 (G) of the second pixel group 62, and the same repeated sequence of consecutive color dots are arranged sequentially and repeatedly in the column direction. The difference between the second embodiment and the fourth embodiment is that, in this embodiment, the area of 4×2 color dots is equal to the corresponding area of 2×2 RGB pixel groups of a conventional RGB stripe display (as shown in FIG. 1).

The advantage of the invention is to provide all multi-primary colors in a single row or column so that by using subpixel rendering method, black and white lines can be formed in rows or columns, thus reducing the number of columns in a multi-primary colors display.

While embodiments of the present invention has been illustrated and described, various modifications and improvements can be made by those skilled in the art. The embodiments of the present invention are therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. An image device, comprising:

a plurality of pixel groups, each of the pixel groups comprising:

one first color dot, one second color dot, one third color dot, and one fourth color dot arranged in a predetermined identical matrix form, wherein each of the first color dot, the second color dot, the third color dot, and the fourth color dot has a different color, and one of the first color dot, the second color dot, the third color dot, and the fourth color is a white color dot, and wherein any repeated sequence of consecutive ones of the color dots in a row direction and in a column direction of the image device comprise the first color dot, the second color dot, the third color dot, the fourth color dot, wherein the repeated sequence of the four consecutive ones of the color dots in the row direction comprises a red color dot, a green color dot, a blue color dot and the white color dot arranged sequentially and repeatedly, and each of the white color dots in the image device is arranged immediately one after another of the white color dots along a plurality of first parallel lines extending in a first diagonal direction of the image device.

2. The image device according to claim 1, wherein two others of the first color dot, the second color dot, the third color dot, and the fourth color dot are a red color dot and a blue color dot which are disposed on diagonal positions of the predetermined identical matrix of the pixel group.

3. The image device according to claim 1, wherein each one of the pixel groups of the image device includes a 2×2 matrix of four of the color dots, and each one of RGB pixel groups in a 2×2 matrix of an RGB display includes one red color dot, one green color dot, and one blue color dot, and an area of each one of the pixel groups of the image display with the 2×2 matrix of the four color dots is equal to a combined area of the 2×2 matrix of four of the RGB pixel groups in the RGB display.

4. The image device according to claim 1, wherein each one of the pixel groups of the image device includes a 3×2 matrix of six of the color dots, and each one of RGB pixel groups in a 2×2 matrix of an RGB display includes one red color dot, one green color dot, and one blue color dot, and an area of each one of the pixel groups of the image display with the 3×2 matrix of the six color dots is equal to a combined area of the 2×2 matrix of four of the RGB pixel groups in the RGB display.

5. The image device according to claim 1, wherein each one of the pixel groups of the image device includes a 3×3 matrix of nine of the color dots, and each one of RGB pixel groups in a 2×2 matrix of an RGB display includes one red color dot, one green color dot, and one blue color dot, and an area of each one of the pixel groups of the image display with the 3×3 matrix of the nine color dots is equal to a combined area of the 2×2 matrix of four of the RGB pixel groups in the RGB display.

6. The image device according to claim 1, wherein each one of the pixel groups of the image device includes a 4×2 matrix of eight of the color dots, and each one of RGB pixel groups in a 2×2 matrix of an RGB display includes one red color dot, one green color dot, and one blue color dot, and an area of each one of the pixel groups of the image display with the 4×2 matrix of the eight color dots is equal to a combined area of the 2×2 matrix of four of the RGB pixel groups in the RGB display.

7. The image device according to claim 1, wherein no two of the first color dots share a common edge line.

8. The image device according to claim 1, wherein each of the pixel groups comprises four of the color dots arranged in a 2×2 matrix.

9. The image device according to claim 8, wherein the one first color dot, the one second color dot, the one third color dot, and the one fourth color dot in an initial 2×2 pixel group in an upper left corner of the image device comprises at least one of the first color dots, at least one of the second color dots, at least one of the third color dots, and at least one of the fourth color dots.

10. The image device according to claim 1, wherein the repeated sequence of consecutive color dots in the column direction comprises the red color dot, the white color dot, the blue color dot and the green color dot arranged sequentially and repeatedly.

11. The image device according to claim 1, each of the pixel groups comprising:

at least one of the first color dots, at least one of the second color dots, at least one of the third color dots, and at least one of the fourth color dots arranged in the predetermined identical matrix form, wherein any of the repeated sequences of the consecutive ones of the color dots in the row direction and in the column direction of the image device include the at least one of the first color dots, the at least one of second color dots, the at least one of third color dots, and the at least one of fourth color dots.

12. The image device according to claim 1, wherein the pixel groups of the image display are arranged such that:

each of the second color dots in the image device is arranged immediately one after another of the second color dots along a plurality of second parallel lines also extending in the first diagonal direction of the image device, wherein each of the first parallel lines of the white color dots is arranged between two of the second parallel lines of the second color dots.

13. The image device according to claim 12, wherein each of the third color dots in the image device is disposed immediately one after another of the third color dots in the second diagonal direction of the image device.

14. An image device, comprising:

a plurality of pixel groups, each of the pixel groups comprising:

a first color dot, a second color dot, a third color dot, and a fourth color dot arranged in a predetermined identical matrix form, wherein each of the first color dot, the second color dot, the third color dot, and the fourth color dot has a different color, and wherein each of the first color dots in the image device is disposed immediately after another of the first color dots in a first diagonal direction of the image device, each of the second color dots in the image device is disposed immediately after another of the second color dots in a second diagonal direction of the image device, and each of the third color dots in the image device is disposed immediately after another of the third color dots in the first diagonal direction of the image device.

15. The image device according to claim 14, wherein each of the fourth color dots is disposed immediately after another of the fourth color dots in the second diagonal direction of the image device.

16. The image device according to claim 14, wherein the first diagonal direction is perpendicular to the second diagonal direction.

17. The image device according to claim 14, wherein the first diagonal direction is not perpendicular to the second diagonal direction.

18. The image device according to claim 14, wherein the first color dots are white color dots.

19. The image device according to claim 14, wherein the second color dots are red color dots, and the third color dots are green dots.

20. The image device according to claim 14, wherein each one of the pixel groups of the image device includes a 2×2 matrix of the four color dots, and each one of RGB pixel groups in a 2×2 matrix of an RGB display includes on red color dot, one green color dot, and one blue color dot, and an area of each one of the pixel groups of the image display with the 2×2 matrix of the four color dots is equal to an area of the 2×2 matrix of four of the RGB pixel groups in the RGB display.

21. The image device according to claim 14, wherein each one of the pixel groups of the image device includes a 3×2 matrix of six of the color dots, and each one of RGB pixel groups in a 2×2 matrix of an RGB display includes one red color dot, one green color dot, and one blue color dot, and an area of each one of the pixel groups of the image display with the 3×2 matrix of the six color dots is equal to a combined area of the 2×2 matrix of four the RGB pixel groups in the RGB display.

22. The image device according to claim 14, wherein each one of the pixel groups of the image device includes a 3×3 matrix of nine of the color dots, and each one of RGB pixel groups in a 2×2 matrix of an RGB display includes one red color dot, one green color dot, and one blue color dot, and an area of each one of the pixel groups of the image display with the 3×3 matrix of the nine color dots is equal to a combined area of the 2×2 matrix of four of the RGB pixel groups in the RGB display.

23. The image device according to claim 14, wherein each one of the pixel groups of the image device includes a 4×2 matrix of eight of the color dots, and each one of RGB pixel groups in a 2×2 matrix of an RGB display includes one red color dot, one green color dot, and one blue color dot, and an area of each one of the pixel groups of the image display with the 4×2 matrix of the eight color dots is equal to a combined area of the 2×2 matrix of four of the RGB pixel groups in the RGB display.

24. The image device according to claim 14, wherein each of the pixel groups comprises four of the color dots arranged in a 2×2 matrix.

25. The image device according to claim 24, wherein the one first color dot, the one second color dot, the one third color dot, and the one fourth color dot in an initial 2×2 pixel group in the upper left corner of the image device comprises at least one of the first color dots, at least one of the second color dots, at least one of the third color dots, and at least one of the fourth color dots.

26. The image device according to claim 14, wherein the repeated sequence of the consecutive one of the color dots in a row direction comprises a red color dot, a green color dot, a blue color dot and the white color dot arranged sequentially and repeatedly, and the repeated sequence of consecutive color dots in the in a column direction comprises the red color dot, the white color dot, the blue color dot and the green color dot arranged sequentially and repeatedly.

* * * * *